US007153148B2

(12) United States Patent
Chen et al.

(10) Patent No.: US 7,153,148 B2
(45) Date of Patent: Dec. 26, 2006

(54) ELECTRONIC DEVICE HAVING A SLIDING CAP

(75) Inventors: Jing Chen, Tianjin (CN); Che-Hung Chen, Taipei (TW)

(73) Assignee: Inventec Multimedia & Telecom Corporation, Taipei (TW)

( * ) Notice: Subject to any disclaimer, the term of this patent is extended or adjusted under 35 U.S.C. 154(b) by 0 days.

(21) Appl. No.: 11/229,720

(22) Filed: Sep. 20, 2005

(65) Prior Publication Data

US 2006/0258196 A1 Nov. 16, 2006

(30) Foreign Application Priority Data

May 13, 2005 (TW) ..... 94207834 U

(51) Int. Cl.
*H01R 13/44* (2006.01)

(52) U.S. Cl. ..... 439/141

(58) Field of Classification Search ..... 439/141, 439/142, 136, 135, 131; 361/115, 737
See application file for complete search history.

(56) References Cited

U.S. PATENT DOCUMENTS 2,567,727 A * 9/1951 Quakenbush ..... 439/837
4,089,032 A * 5/1978 Dell Orfano ..... 361/56
4,445,739 A * 5/1984 Wooten ..... 439/140
4,969,834 A * 11/1990 Johnson ..... 439/141
D357,459 S * 4/1995 Warden ..... D13/138.2
6,522,534 B1 2/2003 Wu
6,733,329 B1 5/2004 Yang
6,744,634 B1 6/2004 Yen
6,763,410 B1 7/2004 Yu

OTHER PUBLICATIONS

MPIO, Flash Audio Players, FY-400, undated, http://www.mplo.com/product/productview_fy400.html.

* cited by examiner

*Primary Examiner*—Alexander Gilman
(74) *Attorney, Agent, or Firm*—Rabin & Berdo, P.C.

(57) ABSTRACT

An electronic device having a sliding cap mainly includes a body, a sliding cap and an elastic element. The body has a transmission end that has a terminal section to couple with external electronic equipment, and a moving area on the outer surface. The sliding cap has an internal chamber to partly cover the transmission end of the body. The sliding cap is movable relative to the body by the guidance of the moving area to a protection position to cover the terminal section, and to a use position to expose the terminal section outside the sliding cap. The elastic element is held in the internal chamber to keep the sliding cap on the protection position in normal conditions.

9 Claims, 4 Drawing Sheets

ELECTRONIC DEVICE HAVING A SLIDING CAP

BACKGROUND

1. Field of Invention

The invention relates to an electronic device, and particularly to an electronic device that has a sliding cap to protect a terminal section.

2. Related Art

With the recent advance of technology electronic devices can provide more diversified functions. Data storage and processing power have also increased greatly. And, their size is gradually reduced and their price is lower.

Many types of electronic devices have been developed to meet different user requirements, such as desktop computers used by enterprises or people for business operation or entertainment, and notebook computers, personal digital assistants (PDAs), mobile phones, smart phones and the like, developed to enhance portability.

Software related to the operation of the electronic devices has also made great progress to meet the requirements of the rapid increase of data volume. The floppy disk previously used can no longer meet user's demands. The optical disk with a greater capacity was subsequently developed. But the optical disk cannot be written repeatedly. Hence, despite its high storage capacity, its capability is still not satisfactory.

These days a novel electronic device called a portable storage device has been developed to overcome the aforesaid problems. It is compact and easy to carry. It has a great capacity and can be written repeatedly. Users can directly insert it into a notebook computer, desktop computer or the like to transmit data. While such memory devices were once expensive and not widely used, with the advance of semiconductor manufacturing processes, these electronic devices are inexpensive now. Hence they have almost become a standard accessory of businesses or ordinary people.

Production techniques of the portable storage device are known in the art. Reference can be found in U.S. Pat. No. 6,522,534 (abbreviated in No. 534 hereinafter), U.S. Pat. No. 6,744,634 (No. 634), U.S. Pat. No. 6,733,329 (No. 329) and 6,763,410 (No. 410).

No. 534 discloses a pen-type portable memory device that has a cap member to couple with one end thereof to cover a terminal portion and provide protection. Nos. 634 and 410 also offer similar designs. No. 410 provides an alteration for the cap member, such as to couple the cap member with the portable storage device on one side through a connector. When the cap member is separated from the portable storage device, the cap member can still be attached to the portable storage device through the connector. With No. 329, in addition to providing a cap member to protect the terminal portion, the terminal portion can also be unplugged and replaced to suit connection ports of varying specifications.

Asides from the cap member to protect the terminal portion, there are also other designs. For instance, the terminal portion may be embedded inside the electronic device, and be extended outside the electronic device by pushing a button when in use. Such a design is often used in MP3 players or the like, such as the MP3 player model No. FY-400 produced by MPIO Co. Ltd. (Korea).

SUMMARY

The invention aims to provide an electronic device equipped with a sliding cap that is different from the products now on the market or the aforesaid techniques.

The electronic device having a sliding cap according to the invention mainly includes a body, a sliding cap and an elastic element. The body includes a transmission end that has a terminal section to connect to external electronic equipment, and a moving area on an outer surface. The sliding cap has an internal chamber to cover the terminal section, and is movable relative to the body by the guiding of the moving area to a protection position to cover the terminal section, and a use position to expose the terminal section outside the sliding cap. The elastic element is held in the internal chamber to keep the sliding cap on the protection position to cover the terminal section in normal conditions.

When in use, exert a force on the sliding cap towards the body to expose the terminal section so that the terminal section can be coupled with electronic equipment such as a notebook computer to transmit data. When not in use, the sliding cap is pushed by the restoring elastic force of the elastic element to return to the protection position to cover the terminal section.

The invention is simply structured, can be produced at a lower cost and is easy to use.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION

Figure 1:
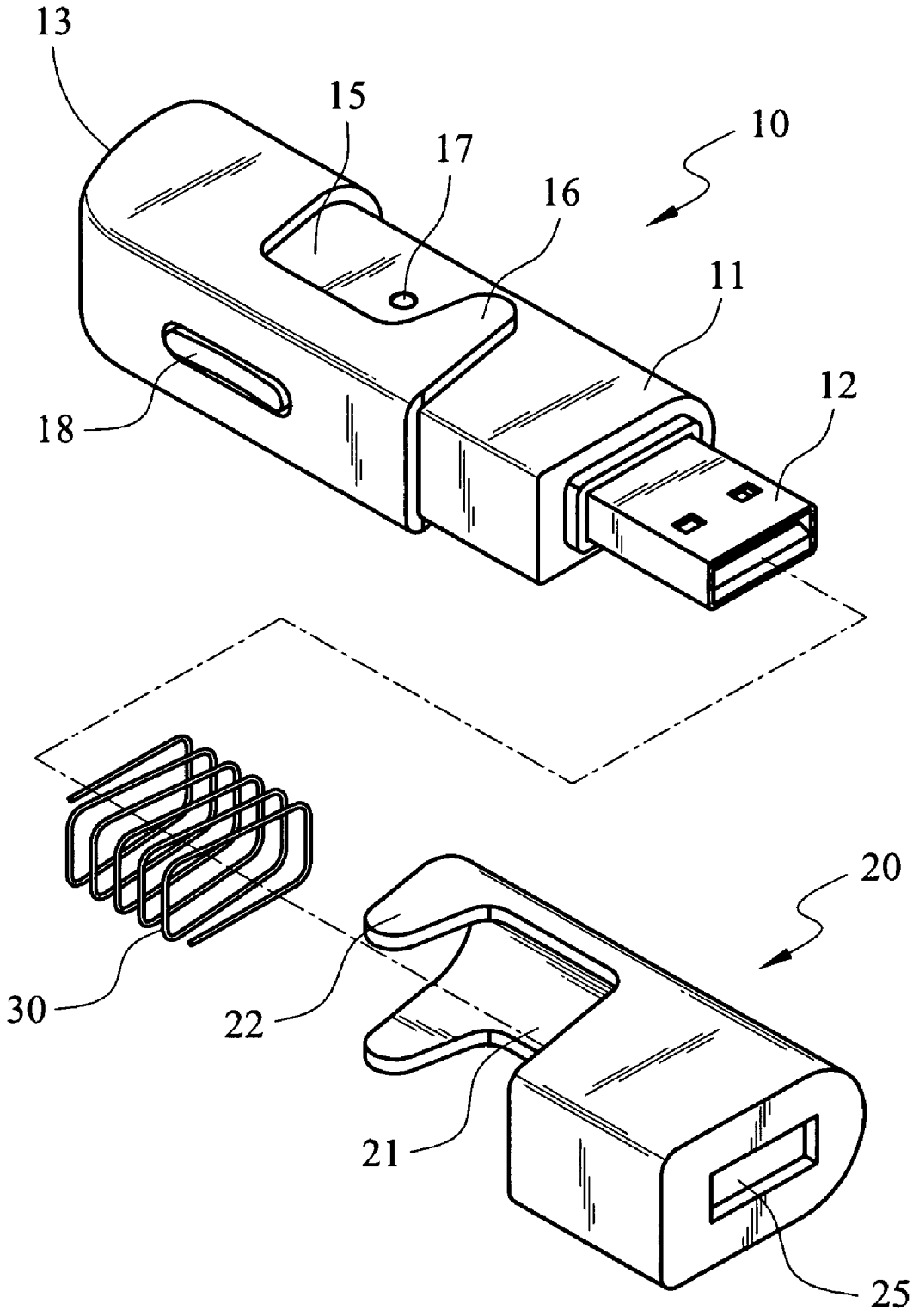
FIG. 1 is an exploded view of the electronic device having a sliding cap of the invention.
Figure 2:
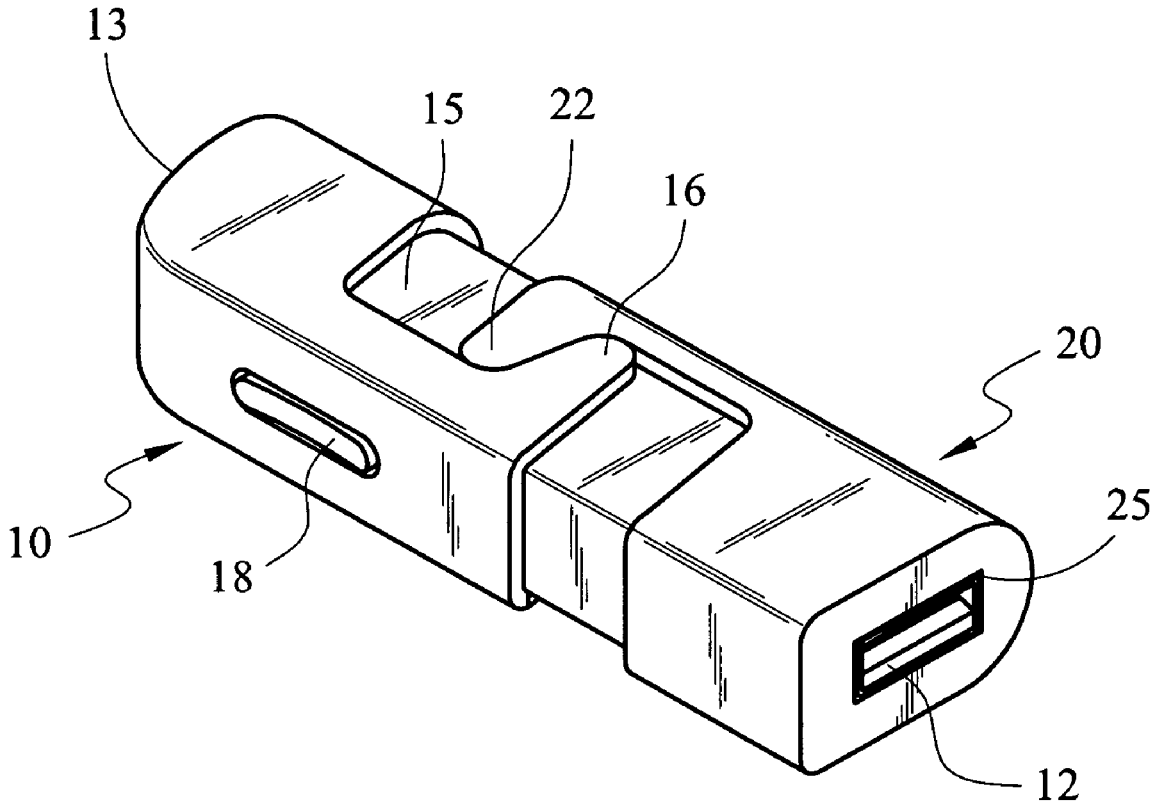
FIG. 2 is a perspective view of the electronic device having a sliding cap of the invention in an assembled condition.
Figure 3:
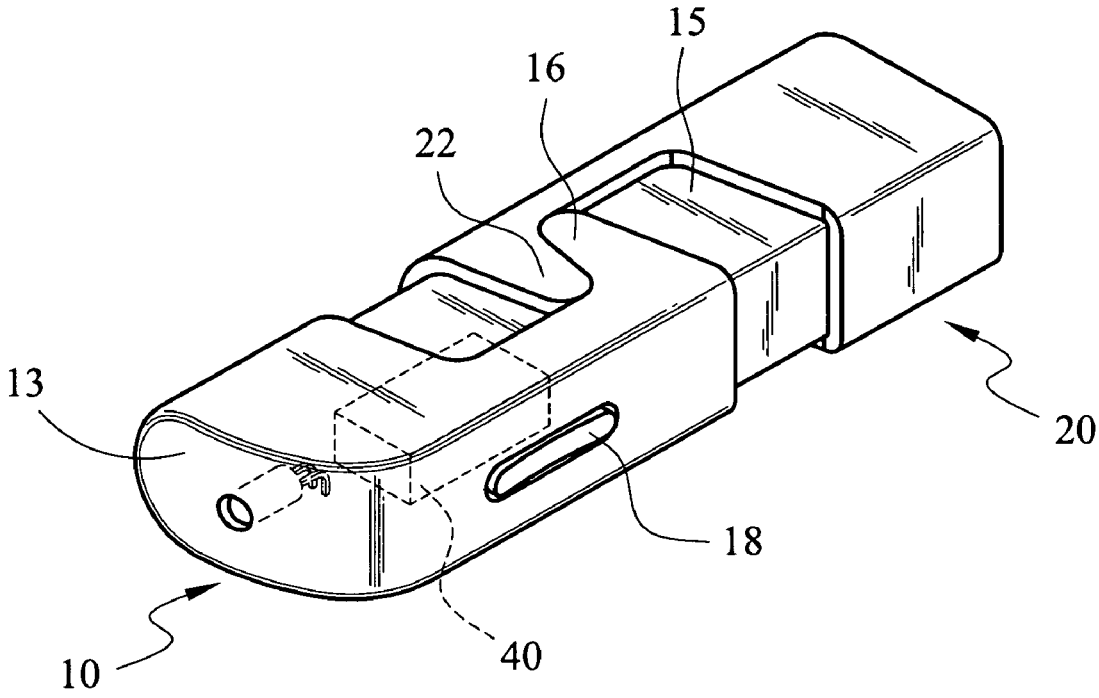
FIG. 3 is another perspective view of the electronic device having a sliding cap of the invention in an assembled condition.

Refer to FIGS. 1 through 4 for an embodiment of the electronic device having a sliding cap of the invention. It mainly includes a body 10, a sliding cap 20 and an elastic element 30. The body 10 houses electronic elements according to requirements. The electronic elements may include, but are not limited to, wireless network communication modules, Bluetooth communication modules, or memory units that may be written repeatedly. These electronic elements are known in the art and form no part of the invention, thus details are omitted. The electronic element in the body 10 shown in the drawings serves only illustrative purposes, so its detailed structure is omitted.

The body 10 has two ends forming respectively a transmission end 11 and an indication end 13. The transmission end 11 has a terminal section 12 to couple with electronic equipment such as a desktop computer, notebook computer or the like. The terminal section 12 has various types, such as a USB plug conforming to the present mainstream. The body 10 further has a moving area 15 on an outer surface. There is a detent block 16 on one end of the moving area 15, and an indication light 17 in the middle portion of the moving area 15 to indicate operation conditions of the electronic elements housed inside. The body 10 may also selectively include a laser indicator 40, which can emit a laser beam through the indication end 13. The body 10 also has a pushbutton 18 on a top side to control operation of the laser indicator 40.

The sliding cap 20 is hollow and has an internal chamber 21 to cover the terminal section 12. The sliding cap 20 has one side extending horizontally to form a pair of pendent ribs 22 corresponding to the detent block, and an opening 25 on another end corresponding to the terminal section 12. The internal chamber 21 houses the elastic element 30 such as a spring. The elastic element 30 has two ends pressing respectively an inner wall of the internal chamber 21 and the transmission end 11 of the body 10.

After the sliding cap 20 is coupled on the transmission end 11 of the body 10, the pendent ribs 22 are located on the moving area 15. The sliding cap 20 can be moved linearly and reciprocally relative to the body 10 by the guiding of the moving area 15. While the sliding cap 20 is moving, the pendent ribs 22 are stopped by the detent block 16, thus the range of motion of the sliding cap 20 is limited.

Figure 4:
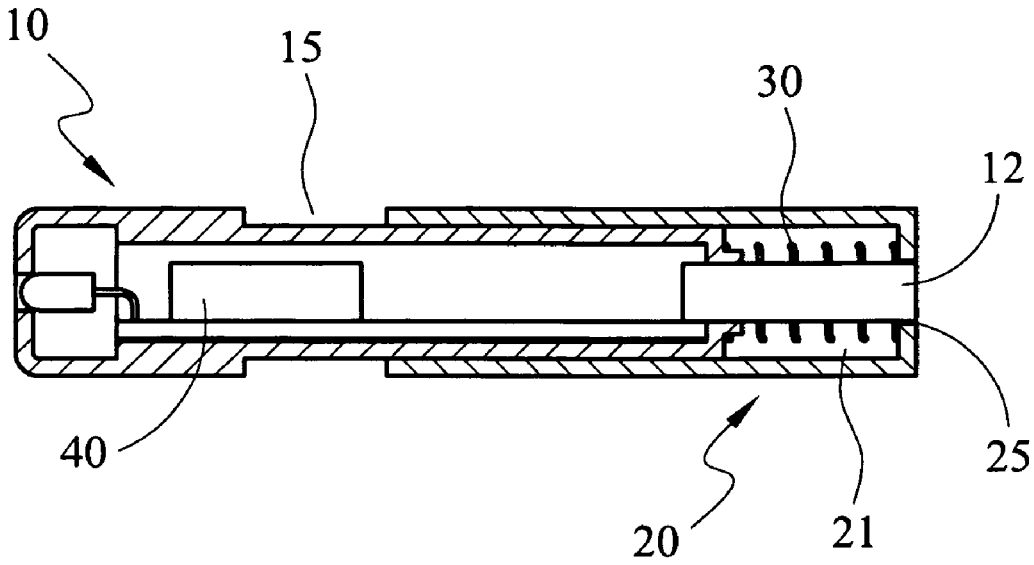
FIG. 4 is a schematic view of the electronic device having a sliding cap of the invention with the sliding cap in a protection position.

Referring to FIG. 4, when the sliding cap 20 covers the transmission end 11 of the body 10, the internal chamber 21 is pushed by the elastic element 30. Hence the sliding cap 20 is located on the protection position in normal conditions and covers the terminal section 12 of the transmission end 11.

Figure 5:
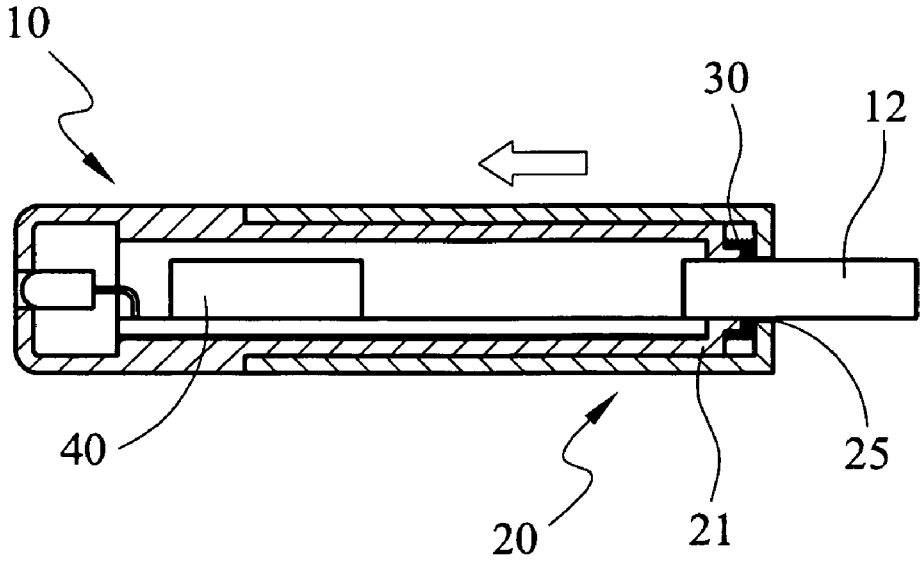
FIG. 5 is a schematic view of the electronic device having a sliding cap of the invention with the sliding cap in a use position.

Referring to FIG. 5, when the sliding cap 20 is subject to a force, the elastic element 30 in the internal chamber 21 is compressed. The sliding cap 20 is moved towards the body 10 in the use position. Hence the terminal section 12 of the transmission end 11 is extended outside through the opening 25 of the sliding cap 20 to be coupled with electronic equipment such as a desktop computer, notebook computer or the like (not shown in the drawings).

When not in use, the body 10 can be unplugged from the electronic equipment. The elastic element 30 provides a restoring elastic force to push the sliding cap 20 from the use position to the protection position to cover the terminal section 12, as shown in FIG. 4.

The embodiment of the invention is simply structured, can be produced at a lower cost, and is easy to use.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electronic memory device having a sliding cap, comprising:

a body having a transmission end which has a terminal section to couple with an external electronic equipment and a moving area on an outer surface;

a sliding cap having an internal chamber to cover the terminal section, and being movable relative to the body guided by the moving area, and having a protection position to cover the terminal section and a use position to expose the terminal section outside the sliding cap; and an elastic element located in the internal chamber to urge the sliding cap to a protection position, the elastic element comprising a spring that is coiled around the terminal section.

2. The electronic memory device having a sliding cap of claim 1, wherein the sliding cap has an opening on one end corresponding to the transmission end.

3. The electronic memory device having a sliding cap of claim 1, wherein the body has an indication light on one side to indicate operation conditions of electronic elements housed in the body.

4. The electronic memory device having a sliding cap of claim 1, further comprising at least one semiconductor memory device within the body, and wherein the terminal section comprises a USB plug that is connected to the at least one semiconductor device.

5. The electronic memory device having a sliding cap of claim 1, wherein the moving area has a detent block to limit moving range of the sliding cap.

6. The electronic memory device having a sliding cap of claim 5, wherein the sliding cap has a pendent rib corresponding to the detent block.

7. The electronic memory device having a sliding cap of claim 1, wherein the body has a laser indicator to emit a laser beam.

8. The electronic memory device having a sliding cap of claim 7, wherein the body has an indication end corresponding to the transmission end, the laser beam being emitted through the indication end.

9. The electronic memory device having a sliding cap of claim 7, wherein the body has a pushbutton on one side to control the laser indicator.

* * * * *